US005984272A

United States Patent [19]

Crider

[11] Patent Number: 5,984,272

[45] Date of Patent: Nov. 16, 1999

[54] TOOL FOR EXTRACTING HEADED NAILS

[76] Inventor: Donald E. Crider, 804 N. Road 400 West, West Lafayette, Ind. 47906

[21] Appl. No.: 08/954,457

[22] Filed: Oct. 20, 1997

[51] Int. Cl.[6] ..... B25C 11/00

[52] U.S. Cl. ..... 254/18

[58] Field of Search ..... 81/418, 419, 420, 81/424.5, 426.5

[56] References Cited

U.S. PATENT DOCUMENTS

| | | | |
|---|---|---|---|
| 942,549 | 12/1909 | Cronk | 81/426.5 |
| 1,310,510 | 3/1919 | Speirs | 81/426.5 |
| 1,495,028 | 5/1924 | Mitchell . | |
| 1,614,628 | 1/1927 | Pym . | |
| 2,196,351 | 4/1940 | Brancati . | |
| 2,328,737 | 9/1943 | Mushet . | |
| 2,495,308 | 1/1950 | Amigone . | |
| 2,519,973 | 8/1950 | Mead . | |
| 2,522,769 | 9/1950 | Anderson . | |
| 2,657,903 | 11/1953 | Johnson . | |
| 2,709,570 | 5/1955 | Henry . | |
| 2,766,008 | 10/1956 | Hurd . | |
| 3,096,975 | 7/1963 | Irwin . | |
| 3,367,703 | 2/1968 | Pittis . | |
| 3,585,704 | 6/1971 | Schroeder . | |
| 3,588,043 | 6/1971 | Griswold . | |
| 3,597,775 | 8/1971 | McCanland . | |
| 3,791,012 | 2/1974 | Jenkin | 29/254 |
| 4,007,913 | 2/1977 | Aldrich . | |
| 4,097,021 | 6/1978 | Loboda . | |
| 4,307,635 | 12/1981 | Genova . | |
| 4,311,069 | 1/1982 | Walker . | |
| 4,386,542 | 6/1983 | Verna . | |
| 4,482,131 | 11/1984 | Hamilton . | |
| 4,505,011 | 3/1985 | Dupuy . | |
| 4,627,420 | 12/1986 | Katz . | |
| 4,669,341 | 6/1987 | Small . | |
| 4,932,638 | 6/1990 | Chen . | |
| 5,056,385 | 10/1991 | Peterson . | |
| 5,119,665 | 6/1992 | Stafford | 81/424.5 |
| 5,141,205 | 8/1992 | Iwai et al. . | |

FOREIGN PATENT DOCUMENTS

| | | |
|---|---|---|
| 334610 | 8/1919 | Germany . |

*Primary Examiner*—David A. Scherbel
*Assistant Examiner*—Daniel G. Shanley
*Attorney, Agent, or Firm*—Woodard, Emhardt, Naughton, Moriarty & McNett

[57] ABSTRACT

A tool for extracting headed nails includes pliers having a handle, a locking lever and first and second pivotally connected jaws each with distal ends, the pliers having an open position wherein the handle and locking lever are disposed apart from each other and the distal ends of the jaws are disposed apart from each other and having a grasping position wherein the handle and the locking lever are disposed toward each other and the distal ends of the jaws are disposed adjacent each other; a slide hammer mechanism including a rod having first and second ends and a hammer member mounted to slide along the rod; and wherein the rod is connected at the first end with the pliers and has a stop at the second end; and, wherein the jaws each define a face at their distal ends and the faces each define a centrally disposed semi-circular cut-out for receiving the shank of a nail therein.

21 Claims, 2 Drawing Sheets

TOOL FOR EXTRACTING HEADED NAILS

FIELD OF THE INVENTION

The present invention relates to extraction devices, and particularly to a device for removing nails from articles into which the nail is embedded.

BACKGROUND OF THE INVENTION

A variety of structures such as pole barns are constructed using corrugated steel or fiberglass as the roofing and/or siding material. In a number of these structures, the corrugated material is affixed to the underlying wood frame with roofing nails. Over time, the once firmly seated nails loosen, creating a gap between the nail and the corrugated material significant to allow water to seep through. As a result, the wood frame close to the loosened nail can rot and weaken. In severe cases, an active drip occurs.

To correct this problem, caulking is sometimes applied around the exterior of the nail, but such action is usually only temporary. The loosened nail may be pounded back into place, but its loosening is usually with respect to the underlying wood frame and, once loosened, the nail will soon unseat itself again and allow the leakage to reoccur. More typically, the nails are removed and replaced with a longer nail or a nail with a rubber gasket or seal. In other instances, the loosened nail is replaced with a screw, with or without a gasket, which is much less likely to later loosen and permit a leak.

In each of these cases, the loosened nail must first be removed, and such removal is typically done with a conventional tool such as a claw hammer, small wrecking bar, tack puller or pliers. In some instances, each of these tools may pull the problem nail without difficulty. On many occasions, however, any one or all of these tools will fail to adequately grip the nail, the head of which may then bend or break off, leaving a deformed nail that is now even more difficult to remove. On still other occasions, the underlying corrugated material has become somewhat brittle, especially after years of exposure to extreme weather conditions. As a result, use of one of these conventional tools will often crack or deform the corrugated material, thus creating a bigger hole or worse leak than before.

What is needed is a device for facilitating the extraction of roofing nails and the like from a material, particularly corrugated steel or fiberglass, which minimizes the risk of damage to such material.

SUMMARY OF THE INVENTION

Generally speaking, there is provided a tool for quickly and easily extracting a headed nail, such as a roofing nail, from a structure. The tool is used to securely grasp and pull the nail with minimal, potentially damaging contact with the structure.

A tool for extracting headed nails includes pliers having a handle, a locking lever and first and second pivotally connected jaws each with distal ends, the pliers having an open position wherein the handle and locking lever are disposed apart from each other and the distal ends of the jaws are disposed apart from each other and having a grasping position wherein the handle and the locking lever are disposed toward each other and the distal ends of the jaws are disposed adjacent each other. The tool further includes a slide hammer mechanism including a rod having first and second ends and a hammer member mounted to slide along the rod, and wherein the rod is connected at the first end with the pliers and has a stop at the second end, and wherein the jaws each define a face at their distal ends and the faces each define a centrally disposed semi-circular cut-out for receiving the shank of a nail therein.

It is an object of the present invention to provide an improved tool for extracting headed nails.

It is another object of the present invention to provide an improved tool for extracting headed nails that creates minimal, potentially damaging contact to the underlying workpiece.

Further objects and advantages to the present invention will become apparent from the following description of the preferred embodiment.

DESCRIPTION OF THE PREFERRED EMBODIMENT

Figure 1:
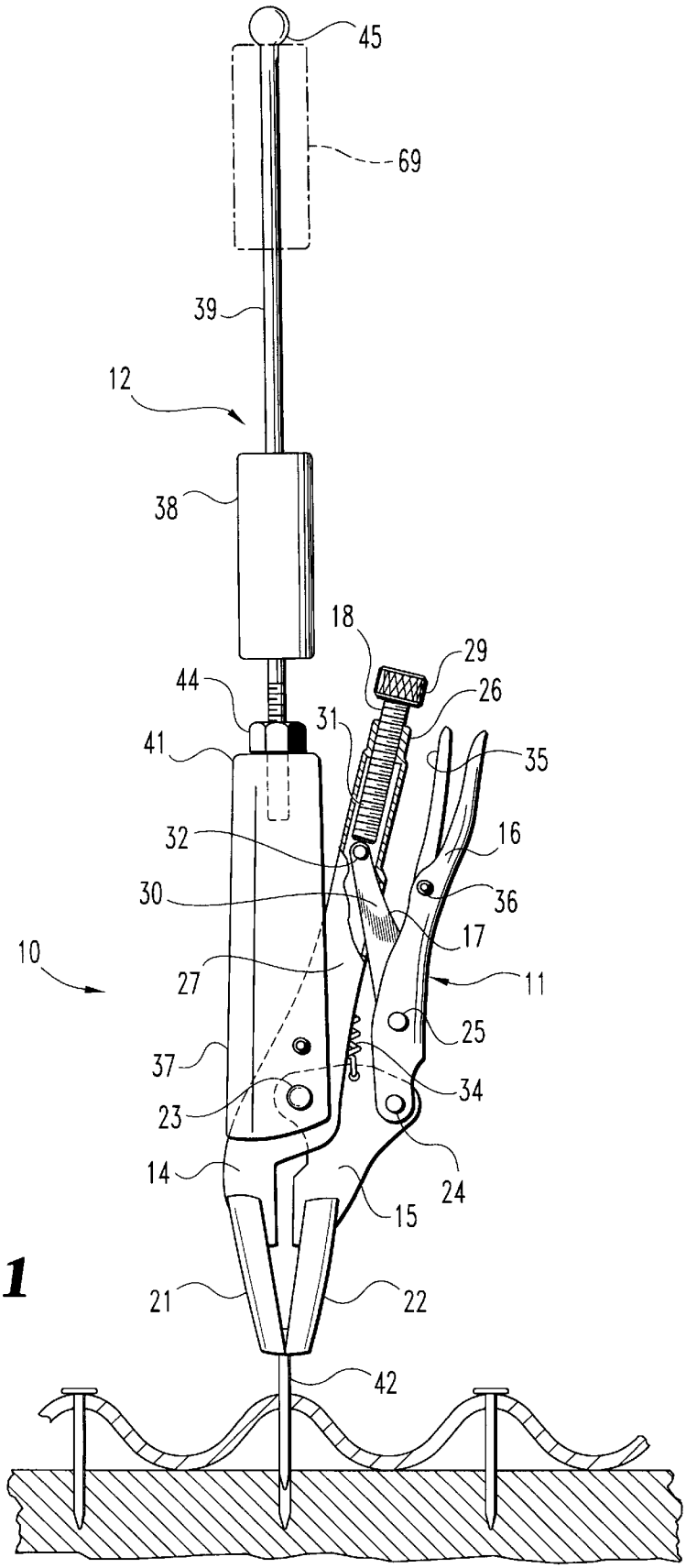
FIG. 1 is an elevational view of the tool 10 for extracting headed nails in accordance with the preferred embodiment of the present invention, with a section of the proximal end of handle 14 broken away for clarity, and shown having pulled a nail 42 substantially from the workpiece.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and further modifications in the illustrated device, and further applications of the principles of the invention as illustrated therein are contemplated as would normally occur to one skilled in the art to which the invention relates.

Referring to FIG. 1, there is shown a tool 10 for extracting headed nails in accordance with the preferred embodiment of the present invention. Tool 10 generally includes locking pliers 11 and a slide hammer 12. Locking pliers 11 are similar to many commercially available locking pliers and generally include a handle 14, a jaw member 15, a locking lever 16, an adjustment link 17 and an adjustment screw 18. Handle 14 and jaw member 15 include first and second opposable jaws 21 and 22 extending from their distal ends. Jaws 21 and 22 may be rigidly connected to handle 14 and jaw member 15, respectively, as shown, or they may be integrally formed with their corresponding handle 14 and jaw member 15 as one piece elements. Jaw member 15 is pivotally connected at pin 23 to handle 14, and locking lever 16 is pivotally connected at one of its ends at pin 24 to jaw member 15. Adjustment link 17 is pivotally connected at pin 25 to locking lever 16 a short distance back from where pin 24 pivotally connects locking lever 16 to jaw member 15.

At its proximal end 26, handle 14 is generally cylindrical and is internally threaded to receive adjustment screw 18 therein. At its intermediate portion 27, handle 14 is generally U-shaped, the open side of the U-shaped portion 27 sized and configured to receive jaw member 15 therein for pivotal attachment at pin 23 and to receive the proximal end 30 of adjustment link 17 therein. Proximal end 30 of link 17 is provided with a pin 32 or other appropriate structure that, along with the distal end 31 of screw 18, are sized and configured for an abutting, and if desired, a pivotally interconnected relationship. A spring 34 extends in tension between handle 14 and jaw member 15 to bias jaws 21 and 22 apart.

In use, handle 14, jaw member 15, locking lever 16 and link 17 form a closed, four-member linkage, each link of such linkage defined here by its termini. That is, link 32–23 is that part of handle 14 between pins 32 and 23, and so on. By advancing and withdrawing screw 18 in or out of handle end 26, the position of pin 32 is varied, thereby varying the length of link 32–23. For a given length of link 32–23, squeezing locking lever 16 against handle 14 urges pin 25 toward handle 14, whereby links 32–25 and 25–24 are brought toward being in alignment and jaw member 15 is thus pivoted clockwise (as viewed in FIG. 1) about pin 23, and jaws 21 and 22 are brought together to a closed or grasping position. For a specific length of link 32–23, locking lever 16 may be pulled far enough toward handle 14 so that before, or just as jaw 22 contacts jaw 21, pin 25 passes from the right (as viewed in FIG. 1) of a straight line extending between pin 32 and pin 24 (i.e. dead center), to the left of such line. If jaws 21 and 22 are now abutting one another or are grasping something therebetween, the linkage will be "locked." That is, to open jaws 21 and 22, jaw member 15 must pivot counterclockwise about pin 23 which, through link 24–25, would urge pin 25 further to the left which generally would urge link 25–32 to rotate clockwise about pin 32 which it is unable to do because of the adjacent, and then abutting handle 14. As is customary in locking pliers of this type, a release lever 35 is provided to push lever 16 and pin 25 away from handle 14, back to the right of dead center, which releases pliers 11 from the locked position.

A hammer collar 37 having a generally U-shaped cross-section is integrally formed with, or rigidly connected as by welding, to handle 14. An internally threaded sleeve 40 is fixed within collar 37 at the proximal end 41 thereof. Slide hammer 12 includes a hammer 38 and an elongate rod 39 that is threadedly received into sleeve 40 such that the axis of rod 39 extends substantially perfectly between opposable jaws 21 and 22, and therefore substantially coexists with the axis of nail 42 that is to be pulled. A lock nut 44 is threadedly received over rod 39 to be advanced against collar 37 to lock rod 39 tightly with collar 37. Hammer 38 is generally a weighted, cylindrical member with an axial passage sized to receive rod 39 therethrough. At its proximal end, rod 39 defines an appropriate hammer stop such as a formed ball 45.

Figure 2:
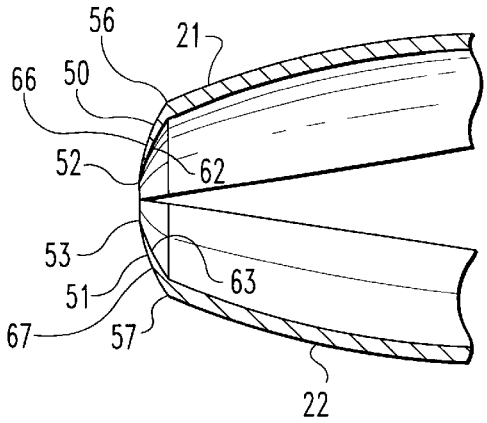
FIG. 2 is a side cross-sectional view of jaws 21 and 22 of tool 10 of FIG. 1 with jaws 21 and 22 in the closed, nail grasping position.
Figure 3:
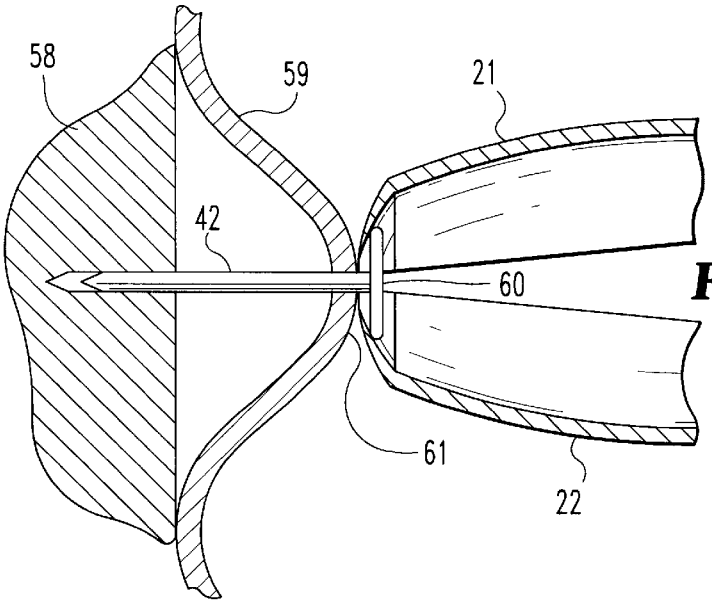
FIG. 3 is a side cross-sectional view of jaws 21 and 22 of the tool of FIG. 1 and showing the jaws engaged with nail 42 just prior to actuation of slide hammer 12.
Figure 4:
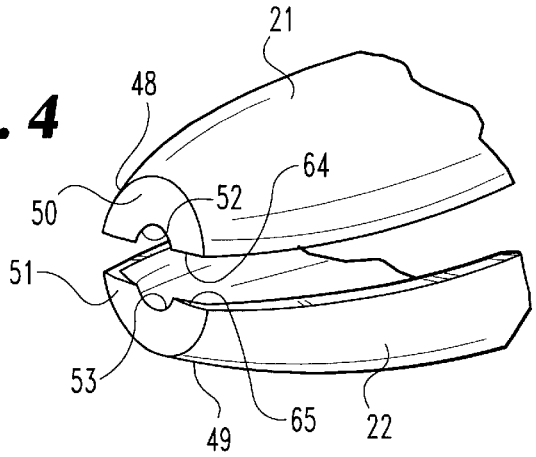
FIG. 4 is a perspective view of jaws 21 and 22 of tool 10 of FIG. 1 and shown in the slightly opened position.
Figure 5:
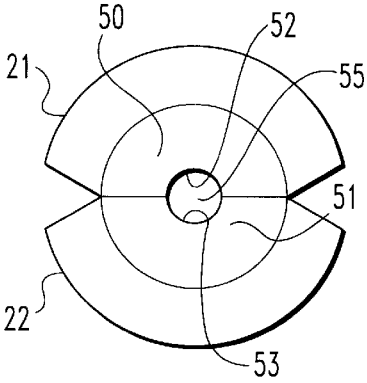
FIG. 5 is an end view of jaws 21 and 22 of FIG. 2.

Referring to FIGS. 2–5, opposable jaws 21 and 22 are substantially identical and are each generally hemi-cylindrical, but with a light taper toward their distal ends 48 and 49, respectively. At their distal ends 48 and 49, jaws 21 and 22 define mutually approaching, nail engaging faces 50 and 51, respectively. Faces 50 and 51 are generally co-planar, but in the preferred embodiment, are somewhat curved, together forming a slightly domed profile when jaws 21 and 22 are brought together to the grasping position, as shown in FIGS. 2 and 3. Faces 50 and 51 further define opposing generally semi-circular cut-outs 52 and 53, respectively, that, when jaws 21 and 22 are together (FIGS. 2, 3 and 5), together form a generally circular opening 55 that has a diameter approximately equal to that of the shank of a standard roofing nail. In the preferred embodiment, circular opening 55 also defines an axis (not shown) that is substantially aligned with the axis (not shown) of rod 39 so that, in use, most if not all of the kinetic energy of hammer 38 will be imparted to nail 42, as described below. The wall thicknesses of faces 50 and 51 taper from their outermost points (e.g. at 56 and 57, respectively) to cutouts 52 and 53, preferably to zero, that is, a somewhat sharpened edge.

Tool 10 is used as follows: Screw 18 is adjusted so that the distal ends 48 and 49 of jaws 21 and 22 are just brought into an abutting relationship when handle 14 and locking lever 16 are squeezed all the way together into a locked position. Handle 14 and locking lever 16 are then released from their locked position, thereby separating jaws 21 and 22. Tool 10 is then maneuvered so that the distal ends 48 and 49 of jaws 21 and 22 are positioned on opposite sides of head 60 of the nail 42 that is to be removed from the workpiece. In one case, the workpiece is corrugated PVC 59. As handle 14 and locking lever 16 are squeezed together, jaws 21 and 22 are moved toward each other so that the curved faces 50 and 51 are brought into a mutually converging, wedging relationship between the head 60 of nail 42 and the locally adjacent surface 61 of the corrugated PVC 59. Because of the diverging thicknesses of faces 50 and 51 radially away from the edges of cut-outs 52 and 53, the inner surfaces 62 and 63, respectively, of faces 50 and 51 curve inwardly even more than the outer surfaces 66 and 67. This difference in curvature may be achieved in a variety of ways. In one embodiment, inner surfaces 62 and 63 each have a uniform radius of curvature that is less than the radius of curvature of the outer surfaces 66 and 67. In another embodiment, the radii of curvature of inner and outer surfaces 62, 63, 66 and 67 may not be uniform, but the centers corresponding to the radii of curvatures for points on the inner surfaces 62 and 63 are more distal than the centers corresponding to the radii of curvature for the closest corresponding points on the outer surfaces 66 and 67.

The curvature of the inner surfaces 62 and 63 and the difference in curvatures between the inner and outer surfaces 62, 63, 66 and 67 act initially to pull nail 42 gently, a small distance away from PVC surface 61, as shown in FIG. 3. When handle 14 and locking lever 16 are brought completely together into a locking position, nail 42 will have been slightly dislodged and loosened from its otherwise fully seated position. Typically, this initial dislodgement may reduce the normal force component acting by the workpiece on the nail and/or will reduce the coefficient of friction between the workpiece and the nail, thereby reducing the force necessary to pull the nail the rest of the way from the workpiece. With handle 14 and locking lever 16 squeezed together to the locked position, the lower, generally diametrical edges 64 and 65 of faces 50 and 51, respectively, are touching or very nearly touching each other, and cut-outs 52 and 53 are encircling the shank of nail 42 just below head 60. Preferably, tool 10 is positioned as shown in FIG. 1 so that rod 39 is substantially coaxial with nail 42. Nail 42 may then be removable simply by pulling with the pliers along the axis of the nail. Typically, however, additional pulling force is required by transmitting the kinetic energy of a moving, weighted body to the pliers by quickly sliding hammer 38 from its lowest position adjacent lock nut 44, along rod 38 to the top (at 69) where it is stopped by ball stop 45. The kinetic energy imparted from hammer 38 to ball stop 45 is transmitted through the rest of tool 10, ultimately to nail 42 which is thus jerked from the PVC 59 and underlying structure 58 with little or no adverse affect to PVC 59. Additional pulling force may be applied simultaneously by the user by pulling with the pliers while operating the slide hammer.

The configuration of jaws 21 and 22, and specifically curved faces 50 and 51 and cut-outs 52 and 53 facilitates a reliable engagement with and removal of nail 42 without damaging the workpiece 58 or PVC 59. If a single jerk of hammer 38 along rod 39 does not completely free the nail 42 from the workpiece (FIG. 1), tool 10 is still firmly engaged with nail 42 so that a second and, if necessary, third subsequent pull may be applied.

Alternative embodiments are contemplated wherein the locking pliers have a different configuration or have more or fewer features. For example, and in no way limiting, the pliers may still be able to be locked in the closed position, but may not be adjustable. Or, the pliers may not be lockable at all. In such case, the pliers may be standard pliers where the handle and one of the jaws are rigidly connected together or are integrally formed as a one piece unit and the locking lever and other of the jaws are likewise rigidly connected together or integrally formed as a one piece unit.

Other embodiments are also contemplated where the pulling of the nail, once securely grasped by the specially formed jaws, is accomplished with alternative structure. As an example, and in no way limiting, the slide hammer could be replaced with another mechanism that imparts kinetic energy to the nail through the pliers, or that permits an unconnected tool, such as a hammer, to supply the kinetic energy. A further embodiment is contemplated wherein hammer collar 37 is pivotally connected to handle 14.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tool for extracting headed nails, comprising:

pliers having a handle, a locking lever and first and second pivotally connected jaws each with distal ends, said pliers having an open position wherein the handle and locking lever are disposed apart from each other and having a grasping position wherein the handle and the locking lever are disposed toward each other and the distal ends of said jaws are disposed adjacent each other;

a slide hammer mechanism including a rod having first and second ends and a hammer member mounted to slide along the rod, and wherein the rod is connected at the first end with said pliers and has a stop at the second end; and, wherein the jaws each define a face at their distal ends and the faces each define a centrally disposed semi-circular cut-out for receiving the shank of a nail therein, the faces of the jaws being curved forming a distally extending, dome-like configuration when said pliers are in the grasping position, the faces having a wall thickness that tapers radially inwardly toward the cut-outs.

2. The tool for extracting headed nails of claim 1, wherein the semi-circular cut-outs of the faces define a generally circular opening when said pliers are in the grasping position.

3. The tool for extracting headed nails of claim 1 wherein the semi-circular cut-outs of the faces define a generally circular opening when said pliers are in the grasping position.

4. The tool for extracting headed nails of claim 1 wherein the faces have a wall thickness that tapers to zero at the radially innermost point.

5. The tool for extracting headed nails of claim 1 wherein each of the faces define inner and outer wall surfaces, each wall surface having an average radius of curvature, and wherein the radius of curvature of the inner wall surfaces is less than the radius of curvature of the outer wall surfaces.

6. The tool for extracting headed nails of claim 1 wherein the pliers have a configuration such that, when the pliers are in the grasping position, the cut-outs define an axis and each of the faces define inner and outer wall surfaces, each wall surface having points each with a radius of curvature and corresponding center, and wherein each point on the inner wall surface has a corresponding point on the outer wall surface that is closer than any other point on the outer wall surface, and wherein the corresponding centers of the radii of curvature of most points on the inner wall surfaces are more distal than the corresponding centers of the radii of curvature of each corresponding point on the outer wall surfaces.

7. The tool for extracting headed nails of claim 1 wherein the jaws define mutually opposing, hemi-cylindrical cavities for receiving the head of the nail.

8. The tool for extracting headed nails of claim 1 wherein the handle is rigidly connected with the first jaw.

9. The tool for extracting headed nails of claim 8 wherein the rod is pivotally connected to the handle.

10. The tool for extracting headed nails of claim 8 wherein the rod is rigidly connected to the handle.

11. The tool for extracting headed nails of claim 10 wherein the semi-circular cut-outs of the faces define a generally circular opening when said pliers are in the grasping position, and wherein said generally circular opening defines an axis which is substantially aligned with the axis of the rod.

12. A method for extracting a headed nail from a workpiece, the nail having a shank with an axis and a head, comprising the steps of:

providing a tool extracting headed nails, said tool including pliers having a handle, a lever and first and second pivotally connected jaws each with distal ends, and including a slide hammer mechanism including a rod having first and second ends and a hammer member mounted to slide along the rod, and wherein the rod is connected at the first end with the pliers and has a stop at the second end, and wherein said pliers have an open position wherein the handle and locking lever are disposed apart from each other and the distal ends of the jaws are disposed apart from each other and wherein said pliers have a grasping position wherein the handle and the lever are disposed toward each other and the distal ends of said jaws are disposed adjacent each other, and wherein the jaws each define a face at their distal ends and the faces each define a centrally disposed semi-circular cut-out for receiving the shank of a nail therein, the faces of the jaws being curved forming a distally extending, dome-like structure when said pliers are in the grasping position, and the faces having a wall thickness that tapers radially inwardly toward the cut-outs;

positioning the pliers proximal to the head of the nail with the faces disposed on opposite sides of the head;

manipulating the pliers from the open position to the grasping position so that the faces wedge between the head and the workpiece, and the shank of the nail is disposed substantially within both semi-circular cut-outs; and imparting a pulling force to the nail by accelerating the hammer along the rod to the stop at the second end of the rod.

13. The method for extracting a headed nail from a workpiece of claim 12 further including the step of exerting a manual pulling once on the nail, while the pliers are in the grasping position, by pulling the pliers along the axis of the nail.

14. The method for extracting a headed nail from a workpiece of claim 12 wherein the imparting step includes the rod being substantially aligned with the axis of the nail while accelerating the hammer.

15. The method for extracting a headed nail from a workpiece of claim 14 wherein the providing step includes the faces having a wall thickness that tapers radially inwardly to the cut-outs where said wall thickness is zero.

16. The method for extracting a headed nail from a workpiece of claim 14 wherein the providing step includes each of the faces defining inner and outer wall surfaces, each wall surface having an average radius of curvature, and wherein the radius of curvature of the inner wall surfaces is less than the radius of curvature of the outer wall surfaces.

17. The method for extracting a headed nail from a workpiece of claim 14 wherein the providing step includes the pliers having a configuration such that, when the pliers are in the grasping position, the cut-outs define an axis and each of the faces define inner and outer wall surfaces, each wall surface having points each with a radius of curvature and corresponding center, and each point on the inner wall surface having a corresponding point on the outer wall surface that is closer than any other point on the outer wall surface, and wherein the corresponding centers of the radii of curvature of most points on the inner wall surfaces are more distal than the corresponding centers of the radii of curvature of each corresponding point on the outer wall surfaces.

18. The method for extracting a headed nail from a workpiece of claim 14 wherein said providing step includes said handle being rigidly connected with the first jaw and said pliers being releasably lockable in the grasping position.

19. The method for extracting a headed nail from a workpiece of claim 14 wherein said providing step includes said rod being pivotally connected to the handle.

20. The method for extracting a headed nail from a workpiece of claim 14 wherein said providing step includes said rod being rigidly connected to the handle.

21. A tool for extracting headed nails, the nails having an axis, comprising:

pliers having a handle, a lever and first and second pivotally connected jaws each with distal ends, said pliers having an open position wherein the handle and lever are disposed apart from each other and having a grasping position wherein the handle and the lever are disposed toward each other and the distal end of said jaws are disposed adjacent each other, and wherein the jaws each define a face at their distal ends and the faces each define a centrally disposed semi-circular cut-out for receiving the shank of a nail therein, the faces of the jaws being substantially coplanar except that the faces are curved forming a distally extending, dome-like configuration when said pliers are in the grasping position, the faces having a wall thickness that tapers radially inwardly toward the cut-outs; and means for imparting a pulling force to and along the axis of the nail through said pliers.

* * * * *